US012589467B2

(12) United States Patent
Nienaber et al.

(10) Patent No.: US 12,589,467 B2
(45) Date of Patent: Mar. 31, 2026

(54) COATED ABRASIVE ARTICLES AND METHODS OF MAKING AND USING THE SAME

(71) Applicant: 3M INNOVATIVE PROPERTIES COMPANY, St. Paul, MN (US)

(72) Inventors: Aaron K. Nienaber, Lake Elmo, MN (US); Joseph B. Eckel, Vadnais Heights, MN (US); Ronald D. Jesme, Plymouth, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 428 days.

(21) Appl. No.: 18/002,501

(22) PCT Filed: Jun. 23, 2021

(86) PCT No.: PCT/IB2021/055554

§ 371 (c)(1),
(2) Date: Dec. 20, 2022

(87) PCT Pub. No.: WO2022/003498

PCT Pub. Date: Jan. 6, 2022

(65) Prior Publication Data

US 2023/0150092 A1 May 18, 2023

Related U.S. Application Data

(60) Provisional application No. 63/046,152, filed on Jun. 30, 2020.

(51) Int. Cl.
*B24D 11/00* (2006.01)
*B24D 3/06* (2006.01)
(Continued)

(52) U.S. Cl.
CPC ..... *B24D 11/001* (2013.01); *B24D 3/06* (2013.01); *B24D 3/28* (2013.01); *B24D 11/02* (2013.01)

(58) Field of Classification Search
CPC ..... B24B 29/00; B24B 21/00; B24B 37/245; B24B 37/14; C09K 3/1409; C09K 3/1436;
(Continued)

(56) References Cited

U.S. PATENT DOCUMENTS 1,910,444 A 5/1933 Nicholson
3,041,156 A 6/1962 Rowse et al.
(Continued)

FOREIGN PATENT DOCUMENTS

EP 0925151 B1 7/2003
JP 58196974 A 11/1983
(Continued)

OTHER PUBLICATIONS

International Search Report for PCT Application No. PCT/IB2021/055554, malled on Sep. 28, 2021, 4 pages.
(Continued)

*Primary Examiner* — Robert F Neibaur
(74) *Attorney, Agent, or Firm* — Kathleen B. Gross; Katherine M. Scholz; Bradford B. Wright

(57) ABSTRACT

Coated abrasive articles comprises a backing having a major surface with an abrasive layer disposed thereon. The abrasive layer has an outer major surface comprising ridges separated by valleys, wherein the abrasive layer comprises magnetizable particles and abrasive particles in a binder. Each of the ridges is irregularly shaped and is oriented along at least a portion of its length substantially parallel to adjacent ridges. Methods of making the same involving a modulated magnetic field are also disclosed.

20 Claims, 4 Drawing Sheets

(51) Int. Cl.
*B24D 3/28* (2006.01)
*B24D 11/02* (2006.01)

(58) Field of Classification Search
CPC .. B24D 3/00–348; B24D 3/001; B24D 3/002; B24D 3/004; B24D 3/008; B24D 3/28; B24D 3/34; B24D 11/02; B24D 11/001; B24D 11/00; B24D 2203/00; B24D 18/0072; B24D 18/009; B24D 18/001–007; Y10T 428/2982; Y10T 428/2991; Y10T 428/2993
USPC .... 51/295, 298, 307, 308, 309; 451/59, 526, 451/533, 534, 539, 538
See application file for complete search history.

(56) References Cited

U.S. PATENT DOCUMENTS

| | | | | |
|---|---|---|---|---|
| 4,314,827 | A | | 2/1982 | Leitheiser et al. |
| 4,588,419 | A | | 5/1986 | Caul et al. |
| 4,623,364 | A | | 11/1986 | Cottringer et al. |
| 4,652,275 | A | | 3/1987 | Bloecher et al. |
| 4,734,104 | A | | 3/1988 | Broberg |
| 4,737,163 | A | | 4/1988 | Larkey |
| 4,744,802 | A | | 5/1988 | Schwabel |
| 4,751,138 | A | | 6/1988 | Tumey et al. |
| 4,770,671 | A | | 9/1988 | Monroe et al. |
| 4,799,939 | A | | 1/1989 | Bloecher et al. |
| 4,881,951 | A | | 11/1989 | Wood et al. |
| 4,997,461 | A | | 3/1991 | Markhoff-Matheny et al. |
| 5,009,675 | A | | 4/1991 | Kunz et al. |
| 5,011,508 | A | | 4/1991 | Wald et al. |
| 5,042,991 | A | | 8/1991 | Kunz et al. |
| 5,085,671 | A | | 2/1992 | Martin et al. |
| 5,108,463 | A | | 4/1992 | Buchanan |
| 5,137,542 | A | | 8/1992 | Buchanan et al. |
| 5,152,917 | A | | 10/1992 | Pieper et al. |
| 5,201,916 | A | | 4/1993 | Berg et al. |
| 5,203,884 | A | | 4/1993 | Buchanan et al. |
| 5,213,591 | A | | 5/1993 | Celikkaya et al. |
| 5,328,716 | A | | 7/1994 | Buchanan |
| 5,352,254 | A | | 10/1994 | Celikkaya |
| 5,366,523 | A | | 11/1994 | Rowenhorst et al. |
| 5,378,251 | A | | 1/1995 | Culler et al. |
| 5,435,816 | A | | 7/1995 | Spurgeon et al. |
| 5,436,063 | A | | 7/1995 | Follett et al. |
| 5,496,386 | A | | 3/1996 | Broberg et al. |
| 5,520,711 | A | | 5/1996 | Helmin |
| 5,560,753 | A | | 10/1996 | Schnabel et al. |
| 5,609,706 | A | | 3/1997 | Benedict et al. |
| RE35,570 | E | * | 7/1997 | Rowenhorst ..... C09K 3/1418 51/293 |
| 5,672,097 | A | | 9/1997 | Hoopman |
| 5,700,302 | A | | 12/1997 | Stoetzel et al. |
| 5,946,991 | A | | 9/1999 | Hoopman |
| 5,958,794 | A | * | 9/1999 | Bruxvoort ..... B24B 7/228 438/692 |
| 5,961,674 | A | | 10/1999 | Gagliardi et al. |
| 5,975,987 | A | | 11/1999 | Hoopman et al. |
| 5,975,988 | A | | 11/1999 | Christianson |
| 5,984,988 | A | | 11/1999 | Berg et al. |
| 6,129,540 | A | | 10/2000 | Hoopman et al. |
| 6,843,815 | B1 | | 1/2005 | Thurber et al. |
| 7,625,632 | B2 | * | 12/2009 | Argoitia ..... H01F 1/11 428/688 |
| 8,034,137 | B2 | | 10/2011 | Erickson et al. |
| 8,142,531 | B2 | | 3/2012 | Adefris et al. |
| 8,142,532 | B2 | | 3/2012 | Erickson et al. |
| 8,142,891 | B2 | | 3/2012 | Culler et al. |
| 9,771,504 | B2 | | 9/2017 | Adefris |
| 2009/0165394 | A1 | | 7/2009 | Culler et al. |
| 2009/0169816 | A1 | | 7/2009 | Erickson et al. |
| 2012/0227333 | A1 | | 9/2012 | Adefris et al. |
| 2013/0040537 | A1 | | 2/2013 | Schwabel et al. |
| 2013/0125477 | A1 | | 5/2013 | Adefris |
| 2016/0280949 | A1 | | 9/2016 | Song et al. |
| 2019/0249052 | A1 | | 8/2019 | Eckel et al. |
| 2019/0264081 | A1 | | 8/2019 | Nienaber et al. |
| 2019/0270183 | A1 | | 9/2019 | Nelson et al. |
| 2019/0270922 | A1 | | 9/2019 | Adefris |
| 2019/0329380 | A1 | | 10/2019 | Jesme et al. |
| 2019/0344403 | A1 | | 11/2019 | Eckel et al. |
| 2020/0071584 | A1 | | 3/2020 | Miller et al. |

FOREIGN PATENT DOCUMENTS

| | | | | |
|---|---|---|---|---|
| WO | 2018080703 | A1 | | 5/2018 |
| WO | 2018080705 | A1 | | 5/2018 |
| WO | 2018080756 | A1 | | 5/2018 |
| WO | 2018080765 | A1 | | 5/2018 |
| WO | 2018080799 | A1 | | 5/2018 |
| WO | 2018081044 | A1 | | 5/2018 |
| WO | WO-2018136268 | A1 | * | 7/2018 ..... B24D 11/001 |
| WO | 2019207415 | A1 | | 10/2019 |
| WO | 2019207416 | A1 | | 10/2019 |
| WO | 2020018771 | A1 | | 1/2020 |
| WO | 2021214605 | A1 | | 10/2021 |

OTHER PUBLICATIONS

Wang, "A Novel Magnetic Field-Assisted Polishing Method Using Magnetic Compound Slurry and its Performance in Mirror Surface Finishing of Miniature V-Grooves", AIP Advances, Feb. 2016, vol. 6, pp. 056602/1-056602/5.

* cited by examiner

COATED ABRASIVE ARTICLES AND METHODS OF MAKING AND USING THE SAME

CROSS REFERENCE TO RELATED APPLICATIONS

This application is a national stage filing under 35 U.S.C. 371 of PCT/IB2021/055554, filed Jun. 23, 2021, which claims the benefit of U.S. Provisional Application No. 63/046,152, filed Jun. 30, 2020, the disclosure of which is incorporated by reference in its/their entirety herein.

TECHNICAL FIELD

The present disclosure broadly relates to coated abrasive articles and methods of making them.

BACKGROUND

Coated abrasive articles typically have an abrasive layer disposed on a woven or knit fabric backing or a film backing, although some other types are also known.

Some coated abrasive articles have an abrasive layer that include abrasive particles embedded in a make layer and overcoated by a size layer.

Other coated abrasive articles have an abrasive layer comprising abrasive particles dispersed throughout a binder. In many cases, the abrasive layer is composed of shaped abrasive composites disposed on a film backing. Such coated abrasive articles often have very small shaped abrasive composites (often pyramidal or frustopyramidal in shape) and are typically used for fine finishing applications. The effect is to provide an abrading surface with structured topography that can facilitate abrading performance. Many such coated abrasive articles are available from 3M Company under the trade designation TRIZACT.

The manufacturing method to make this type of product requires an expensive machined production tool covered with precisely-shaped microcavities. Moreover, the process itself is difficult to practice.

SUMMARY

The present disclosure provides coated abrasive articles with structured surface topography that can be made without resorting to a molding process. As a result, significant reductions in manufacturing cost, and substantial scrap reduction (i.e., since no production tool is used) are achieved while still obtaining useful abrading performance.

In one aspect, the present disclosure provides a coated abrasive article comprising a backing having a major surface with an abrasive layer disposed thereon, wherein the abrasive layer has an outer major surface comprising ridges separated by valleys, wherein the abrasive layer comprises magnetizable particles and non-magnetizable abrasive particles dispersed in a binder, wherein the abrasive particles comprise at least one of rods, shaped platelets, or crushed abrasive particles conforming to an abrasives industry specified nominal grade, and wherein each one of the ridges is irregularly shaped and is oriented along at least a portion of its length substantially parallel to adjacent ridges.

In another aspect, the present disclosure provides a coated abrasive article comprising:

a backing having a major surface and having a make layer disposed thereon, wherein the make layer has an outer major surface opposite the backing, wherein the outer major surface comprises ridges and valleys, wherein the make layer comprises magnetizable particles, and wherein each one of the ridges is irregularly shaped and is oriented along at least a portion of its length substantially parallel to adjacent ridges; and abrasive particles secured to the make layer proximate the outer major surface of the make layer.

In yet another aspect, the present disclosure provides a method of making a coated abrasive article, the method comprising:

providing a curable binder precursor layer on a backing, wherein the curable binder precursor layer has an outer major surface opposite the backing, wherein the curable binder precursor layer comprises magnetizable particles and abrasive particles dispersed in a curable binder precursor, and wherein the abrasive particles comprise at least one of rods, shaped platelets, or crushed abrasive particles conforming to an abrasives industry specified nominal grade;

forming ridges on the outer major surface of the curable binder precursor layer by modulation of at least one magnetic field relative to the backing; and at least partially curing the curable binder precursor thereby providing an at least partially cured layer.

In yet another aspect, the present disclosure provides a method of making a coated abrasive article, the method comprising sequentially:

providing a curable binder precursor layer on a major surface of a backing, wherein the curable binder precursor layer has an outer major surface opposite the backing, wherein the curable binder precursor layer comprises magnetizable particles dispersed in a curable binder precursor;

forming ridges on the outer major surface of the curable binder precursor layer by modulation of at least one magnetic field relative to the backing;

adhering abrasive particles to the outer major surface of the curable binder precursor layer; and at least partially curing the curable binder precursor thereby providing an at least partially cured layer.

In yet another aspect, the present disclosure provides a method of making a coated abrasive article, the method comprising sequentially:

providing a curable binder precursor layer on a first major surface of a backing, wherein the curable binder precursor layer has an outer major surface opposite the backing, wherein the curable binder precursor layer comprises magnetizable particles dispersed in a curable binder precursor;

adhering abrasive particles to the outer major surface of the curable binder precursor layer;

forming ridges on the outer major surface of the curable binder precursor layer by modulation of at least one magnetic field relative to the backing; and at least partially curing the curable binder precursor thereby providing an at least partially cured layer.

As Used Herein:

The phrase "shaped abrasive particle" refers to an abrasive particle that has a non-random shape imparted by the method (e.g., a molding, screen printing, or 3D fabrication process) used to make it, and expressly excludes mechanically crushed and/or milled particles.

The phrase "precisely-shaped abrasive particle" refers to an abrasive particle with at least at portion of the abrasive particle having a predetermined shape that is replicated from a mold cavity used to form the shaped precursor abrasive particle. A precisely-shaped abrasive particle may have a predetermined geometric shape having planar surfaces and sharp edges and vertices, for example.

The phrase "oriented substantially parallel" means oriented within a range of ±30 degrees, preferably within ±20 degrees, more preferably within ±15 degrees, and still more preferably within ±10 degrees.

The phrase "oriented along at least a portion of its length substantially parallel to adjacent ridges" means that at least a portion of the ridge is substantially parallel to corresponding adjacent portions of the adjacent ridges.

The term "ferrimagnetic" refers to materials that exhibit ferrimagnetism. Ferrimagnetism is a type of permanent magnetism that occurs in solids in which the magnetic fields associated with individual atoms spontaneously align themselves, some parallel, or in the same direction (as in ferromagnetism), and others generally antiparallel, or paired off in opposite directions (as in antiferromagnetism). The magnetic behavior of single crystals of ferrimagnetic materials can be attributed to the parallel alignment; the diluting effect of those atoms in the anti parallel arrangement keeps the magnetic strength of these materials generally less than that of purely ferromagnetic solids such as metallic iron. Ferrimagnetism occurs chiefly in magnetic oxides known as ferrites. The spontaneous alignment that produces ferrimagnetism is entirely disrupted above a temperature called the Curie point, characteristic of each ferrimagnetic material. When the temperature of the material is brought below the Curie point, ferrimagnetism revives.

The term "ferromagnetic" refers to materials that exhibit ferromagnetism. Ferromagnetism is a physical phenomenon in which certain electrically uncharged materials strongly attract others. In contrast to other substances, ferromagnetic materials are magnetized easily, and in strong magnetic fields the magnetization approaches a definite limit called saturation. When a field is applied and then removed, the magnetization does not return to its original value. This phenomenon is referred to as hysteresis. When heated to a certain temperature called the Curie point, which is generally different for each substance, ferromagnetic materials lose their characteristic properties and cease to be magnetic; however, they become ferromagnetic again on cooling.

The term "magnet" can include a ferromagnetic and/or ferrimagnetic material that responds to a magnetic field and acts as a magnet. A magnet can be any material that exerts a magnetic field in either a permanent, semi-permanent, or temporary state. The term "magnet" can be one individual magnet or an assembly of magnets that would act like a single magnet. The term "magnet" can include permanent magnets and electromagnets.

The term "magnetizable" means that the item being referred to is magnetic, or can be made magnetic, using an applied magnetic field and has a magnetic moment of at least 0.001 electromagnetic units (emu), in some cases at least 0.005 emu, and yet other cases 0.01 emu, up to and including 0.1 emu, although this is not a requirement.

The term "non-magnetizable" means not magnetizable at 20° C.

The terms "magnetic" and "magnetized" mean being ferromagnetic or ferrimagnetic at 20° C., unless otherwise specified.

The term "magnetic field" refers to magnetic fields that are intentionally generated and not generated by any astronomical body or bodies (e.g., Earth or the sun) or unintended ambient electromagnetic interference (e.g., due to electrical architectural wiring). In general, magnetic fields used in practice of the present disclosure have a field strength in the region of the magnetizable particles being acted upon of at least about 10 gauss (1 mT), in some cases at least about 100 gauss (10 mT), and in yet other cases at least about 1000 gauss (0.1 T), and in yet other cases at least about 10,000 gauss (1.0 T).

The term "rotation" refers to angular displacement that is at least a portion of an entire revolution or several revolutions.

Features and advantages of the present disclosure will be further understood upon consideration of the detailed description and the appended claims.

Figure 1:
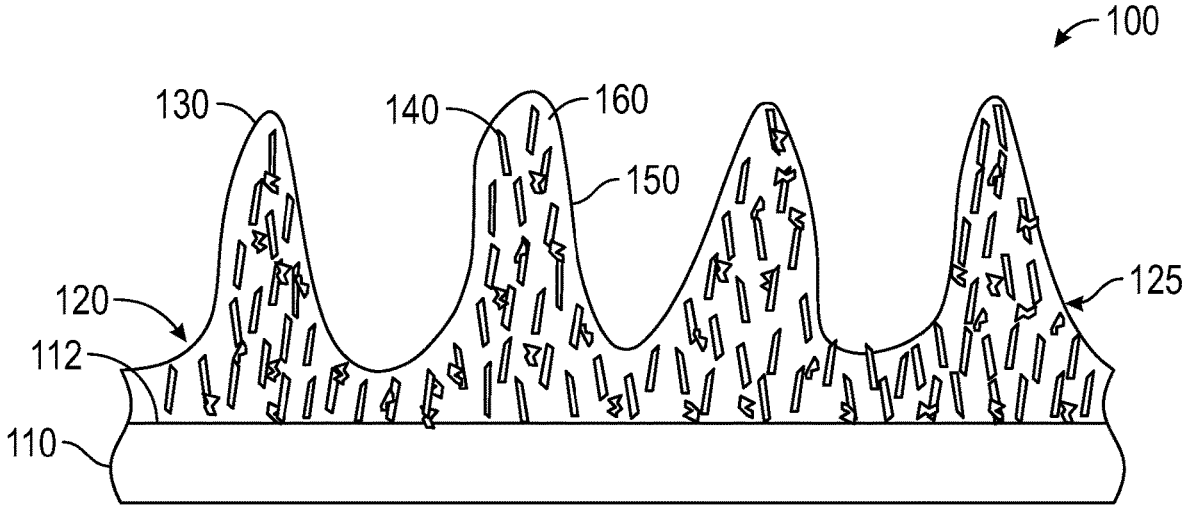
FIG. 1 is a schematic enlarged side view of exemplary coated abrasive article 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Referring now to FIG. 1, exemplary coated abrasive article 100 comprises backing 110 having a major surface 112 with abrasive layer 120 disposed thereon. Outer major surface 125 comprises ridges 130. The abrasive layer 120 comprises magnetizable particles 140 and abrasive particles 150 dispersed in a binder 160.

Figure 1A:
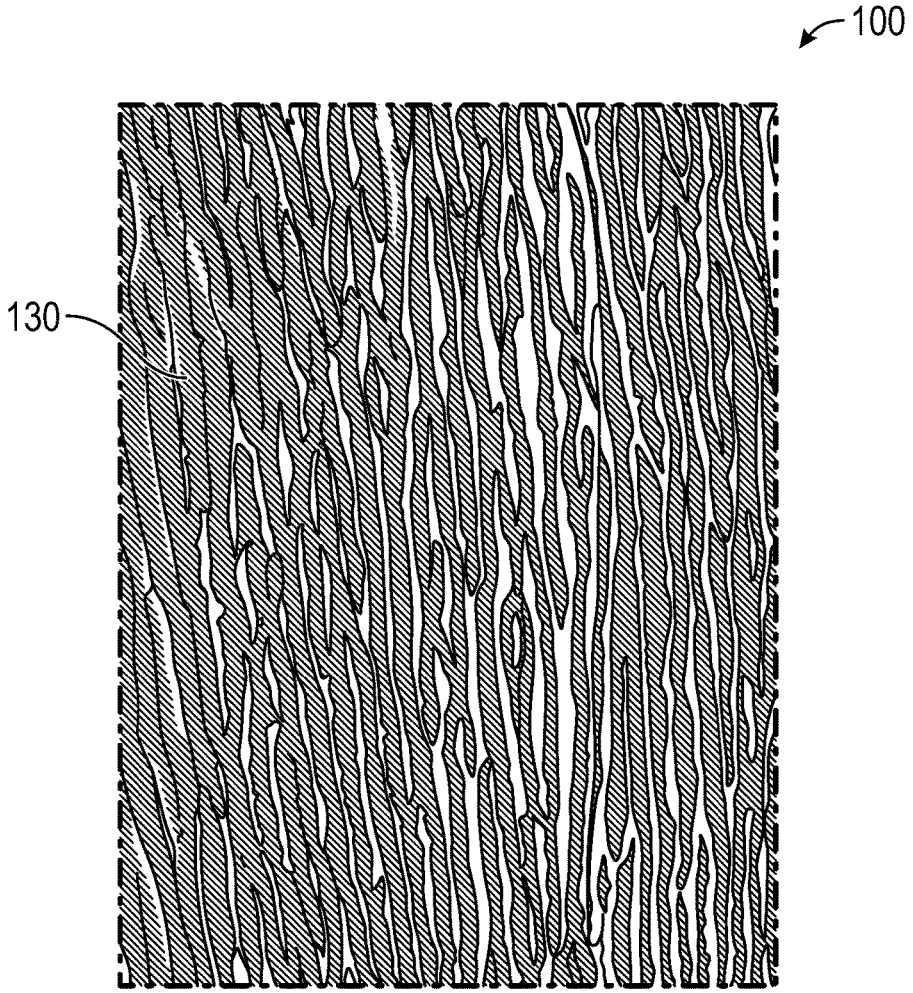
FIG. 1A is a schematic top view of coated abrasive article 100.

Referring now to FIG. 1A, ridges 130 are irregularly shaped and are oriented along at least a portion of its length substantially parallel to adjacent ridges.

Useful backings include, for example, those known in the art for making coated abrasive articles. Typically, the backing has two opposed major surfaces, although this is not a requirement. The thickness of the backing generally ranges from about 0.02 to about 5 millimeters, desirably from about 0.05 to about 2.5 millimeters, and more desirably from about 0.1 to about 1.0 millimeter, although thicknesses outside of these ranges may also be useful. Generally, the strength of the backing should be sufficient to resist tearing or other damage during abrading processes. The thickness and smoothness of the backing should also be suitable to provide the desired thickness and smoothness of the coated abrasive article; for example, depending on the intended application or use of the coated abrasive article.

Exemplary backings include dense nonwoven fabrics (e.g., needletacked, meltspun, spunbonded, hydroentangled, or meltblown nonwoven fabrics), knitted fabrics, stitch-bonded and/or woven fabrics; scrims; thermoplastic polymer films (e.g., polycarbonate, polyester, polypropylene, polyethylene, polymethyl methacrylate, or polyamide films); treated versions thereof; and combinations of two or more of these materials.

Fabric backings can be made from any known fibers, whether natural, synthetic or a blend of natural and synthetic fibers. Examples of useful fiber materials include fibers or yarns comprising polyester (e.g., polyethylene terephthalate), polyamide (e.g., hexamethylene adipamide, polycaprolactam), polypropylene, acrylic, cellulose acetate, polyvinylidene chloride-vinyl chloride copolymers, vinyl chloride-acrylonitrile copolymers, graphite, polyimide, silk, cotton, linen, jute, hemp, or rayon. Useful fibers may be of virgin materials or of recycled or waste materials reclaimed from garment cuttings, carpet manufacturing, fiber manufacturing, or textile processing, for example. Useful fibers may be homogenous or a composite such as a bicomponent fiber (for example, a co-spun sheath-core fiber). The fibers may be tensilized and crimped, but may also be continuous filaments such as those formed by an extrusion process. The backing may be treated to include a presize (i.e., a barrier coat overlying the major surface of the backing onto which the abrasive layer is applied), a backsize (i.e., a barrier coat overlying the major surface of the backing opposite the major surface on which the abrasive layer is applied), a saturant (i.e., a barrier coat that is coated on all exposed surfaces of the backing), or a combination thereof. Useful presize, backsize, and saturant compositions include glue, phenolic resins, lattices, epoxy resins, urea-formaldehyde, urethane, melamine-formaldehyde, neoprene rubber, butyl acrylate, styrol, starch, and combinations thereof. Other optional layers known in the art may also be used (e.g., a tie layer; see, e.g., U.S. Pat. No. 5,700,302 (Stoetzel et al.)).

Backing treatments may contain additional additives such as, for example, a filler and/or an antistatic material (for example, carbon black particles, vanadium pentoxide particles). The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.).

In some preferred embodiments, the backing is compressible and resilient; for example, a foam or a lofty bonded nonwoven web.

The backing may have any suitable basis weight; typically, in a range of from 100 to 1250 grams per square meter (gsm), more typically 450 to 600 gsm, and even more typically 450 to 575 gsm. In many embodiments (e.g., abrasive belts and sheets), the backing typically has good flexibility; however, this is not a requirement (e.g., vulcanized fiber discs). To promote adhesion of binder resins to the backing, one or more surfaces of the backing may be modified by known methods including corona discharge, ultraviolet light exposure, electron beam exposure, flame discharge, and/or scuffing.

Exemplary magnetizable materials that can be suitable for use as magnetizable particles can include: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Hensler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; and ferrites such as magnetite; zinc ferrite; nickel ferrite; cobalt ferrite, magnesium ferrite, manganese zinc ferrite, barium ferrite, and strontium ferrite; yttrium iron garnet; and combinations of the foregoing such as nickel zinc ferrite, cobalt nickel zinc ferrite, and magnesium manganese zinc ferrite. In some embodiments, the magnetizable material includes at least one metal selected from iron, nickel, and cobalt, an alloy of two or more such metals, or an alloy of at one such metal with at least one element selected from phosphorus and manganese. In some embodiments, the magnetizable material is an alloy (e.g., Alnico alloy) containing 8 to 12 weight percent (wt. %) aluminum, 15 to 26 wt. % nickel, 5 to 24 wt. % cobalt, up to 6 wt. % copper, up to 1 wt. % titanium, where the balance of material to add up to 100 wt. % is iron. In some embodiments, the magnetizable particles are carbonyl iron particles. Carbonyl iron can be prepared by the chemical decomposition of purified iron pentacarbonyl. In some embodiments, the magnetizable particles include iron. In some embodiments, the magnetizable particles include carbon and iron. In some embodiments, the magnetizable particles include nickel.

The magnetizable particles can have a major dimension of any size relative to a thickness of the layer they are a part of but can be much smaller than the thickness of the layer in some instances. For example, they can be 1 to 2000 times smaller in some embodiments, in yet other embodiments 100 to 2000 times smaller, and in yet other embodiments 500 to 2000 times smaller, although other sizes can also be used.

Suitable magnetizable particles include particles formed from any of the magnetizable materials described elsewhere, optionally coated with another material, and particles formed from a non-magnetizable material and coated with a magnetizable material. For example, suitable magnetizable particles include nickel-coated graphite flakes, nickel-coated glass spheres, and nickel-coated plastic particles (e.g., nickel coated polymethyl methacrylate (PMMA) particles).

Exemplary abrasive particles, which may be magnetizable or non-magnetizable, include abrasive particles having the shape of rods, shaped (e.g., precisely-shaped) platelets, or crushed abrasive particles conforming to an abrasives industry specified nominal grade, and wherein each one of the ridges is irregularly shaped and is oriented along at least a portion of its length substantially parallel to adjacent ridges.

Useful abrasive particles may be the result of a crushing operation (e.g., crushed abrasive particles that have been sorted for shape and size) or the result of a shaping operation (i.e., shaped abrasive particles) in which an abrasive precursor material is shaped (e.g., molded), dried, and converted to ceramic material. Combinations of abrasive particles resulting from crushing with abrasive particles resulting from a shaping operation may also be used. The abrasive particles may be in the form of, for example, individual particles, agglomerates, composite particles, and mixtures thereof.

The abrasive particles should have sufficient hardness and surface roughness to function as crushed abrasive particles in abrading processes. Preferably, the abrasive particles have a Mohs hardness of at least 4, at least 5, at least 6, at least 7, or even at least 8.

Suitable abrasive particles include, for example, crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromic, zirconia, titania, tin oxide, quartz, feldspar, flint, emery, sol-gel-derived ceramic (e.g., alpha alumina), and combinations thereof. Examples of sol-gel-derived abrasive particles from which the abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the crushed abrasive particles to the binder. The abrasive particles may be treated before combining them with the binder, or they may be surface treated in situ by including a coupling agent to the binder.

Preferably, the abrasive particles (and especially the abrasive particles) comprise ceramic abrasive particles such as, for example, sol-gel-derived polycrystalline alpha alumina particles. Ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.). Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

In some preferred embodiments, useful abrasive particles (especially in the case of the abrasive particles) may be shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, the abrasive particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); U.S. Pat. No. 8,142,532 (Erickson et al.); U.S. Pat. No. 9,771,504 (Adefris); and in U.S. Pat. Appl. Publ. Nos. 2012/0227333 (Adefris et al.); 2013/0040537 (Schwabel et al.); and 2013/0125477 (Adefris). One particularly useful precisely-shaped abrasive particle shape is that of a platelet having three-sidewalls, any of which may be straight or concave, and which may be vertical or sloping with respect to the platelet base; for example, as set forth in the above cited references.

Surface coatings on the abrasive particles may be used to improve the adhesion between the abrasive particles and a binder material, or to aid in electrostatic deposition of the abrasive particles. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent shaped abrasive particles from capping. Capping is the term to describe the phenomenon where metal particles from the workpiece being abraded become welded to the tops of the abrasive particles. Surface coatings to perform the above functions are known to those of skill in the art.

In some embodiments, the abrasive particles may be selected to have a length and/or width in a range of from 0.1 micrometers to 3.5 millimeters (mm), more typically 0.05 mm to 3.0 mm, and more typically 0.1 mm to 2.6 mm, although other lengths and widths may also be used.

The abrasive particles may be selected to have a thickness in a range of from 0.1 micrometer to 1.6 mm, more typically from 1 micrometer to 1.2 mm, although other thicknesses may be used. In some embodiments, abrasive particles may have an aspect ratio (length to thickness) of at least 2, 3, 4, 5, 6, or more.

Abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard) Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, JIS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the shaped abrasive particles pass through a test sieve meeting ASTM E-11 specification for the number 18 sieve and are retained on a test sieve meeting ASTM E-11 specification for the number 20 sieve. In one embodiment, the shaped abrasive particles have a particle size such that most of the particles pass through an 18 mesh test sieve and can be retained on a 20, 25, 30, 35, 40, 45, or 50 mesh test sieve. In various embodiments, the shaped abrasive particles can have a nominal screened grade comprising: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+450, −450+500, or −500+635. Alternatively, a custom mesh size could be used such as −90+100.

Optionally, a supersize layer may be disposed on at least a portion of the abrasive layer (e.g., a slurry layer, abrasive particles embedded in a binder, or the size layer of a make/size layer construction).

Examples of useful supersize layer precursor compositions include metal salts of fatty acids, urea-formaldehyde, novolac phenolic resins, epoxy resins, waxes, mineral oils, and combinations thereof. Upon drying/curing a supersize layer is formed.

If present, the supersize layer typically has a basis weight of 5 to 1100 grams per square meter (gsm), preferably 50 to 700 gsm, and more preferably 250 to 600 gsm, although this is not a requirement. However, the basis weight of the make layer, size layer, and optional supersize layer typically depend at least in part on the abrasive particle size grade and the particular type of coated abrasive article.

Suitable binders used in abrasive layers of the present disclosure (e.g., a slurry layer, make layer, and/or size layer) include, for example, various at least partially, preferably fully, cured binder precursors. Corresponding useful binder precursors include thermally curable resins and radiation curable resins, which may be cured, for example, thermally and/or by exposure to radiation include free-radically polymerizable monomers and/or oligomers, epoxy resins, acrylic resins, urethane resins, phenolic resins, urea-formaldehyde resins, melamine-formaldehyde resins, aminoplast resins, cyanate resins, and combinations thereof. In many cases, a curing agent such as a catalyst, hardener, thermal initiator, or photoinitiator will be included in the binder precursor. Selection of such materials and their amounts are within the capability of those of ordinary skill in the art. Additional details concerning binder precursors may be found, for example, in U.S. Pat. No. 4,588,419 (Caul et al.); U.S. Pat. No. 4,751,138 (Tumey et al.); and U.S. Pat. No. 5,436,063 (Follett et al.).

Binder precursors may optionally be modified by various additives (e.g., fibers, lubricants, wetting agents, surfactants, pigments, dyes, antistatic agents (e.g., carbon black, vanadium oxide, and/or graphite.), coupling agents (e.g., silanes, titanates, zircoaluminates, etc.), plasticizers, suspending agents), processing aids, reinforcing fibers, heat stabilizers, UV stabilizers, and antioxidants. Examples of useful fillers include clays, calcium carbonate, glass beads, talc, clays, mica, wood flour; and carbon black. In some embodiments, a make layer precursor comprises a resole phenolic resin and an organic polymeric rheology modifier of a type suitable for use in a size layer and/or supersize layer precursor, and which may aid in preserving the initial placement and orientation of the abrasive particles during manufacture.

Suitable binders can be hard or soft and flexible. In some embodiments, the binder can be a foam.

The abrasive layer may comprise abrasive particles dispersed in a binder (e.g., a slurry coated cured layer or "slurry layer") or a make layer with abrasive particles embedded therein and an optional (but typically preferred) size layer overlaying both. Optionally, a supersize layer may be disposed on the size layer or slurry layer.

The abrasive layer (e.g., in a slurry layer, make layer, and/or especially a size layer) may further comprise at least one grinding aid. A grinding aid is a material that has a significant effect on the chemical and physical processes of abrading, which results in improved performance. Grinding aids encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include, tin, lead, bismuth, cobalt, antimony, cadmium, iron, and titanium.

Other miscellaneous grinding aids include sulfur, organic sulfur compounds, graphite, and metallic sulfides. A combination of different grinding aids may be used, and in some instances, this may produce a synergistic effect.

Grinding aids can be particularly useful in coated abrasives. In coated abrasive articles, grinding aid is typically used in a supersize layer, which is applied over the surface of a size layer. Sometimes, however, the grinding aid is added to the size layer. Typically, if present, the amount of grinding aid incorporated into coated abrasive articles is about 50–800 grams per square meter ($g/m^2$), preferably about 80–475 $g/m^2$, however, this is not a requirement.

The abrasive layer may be continuous or discontinuous and may contain openings, for example, to facilitate vacuum removal of swarf during use. The abrasive layer may be contiguous or not contiguous. It may be patterned (i.e., according to a predetermined coating pattern) or not.

Figure 2:
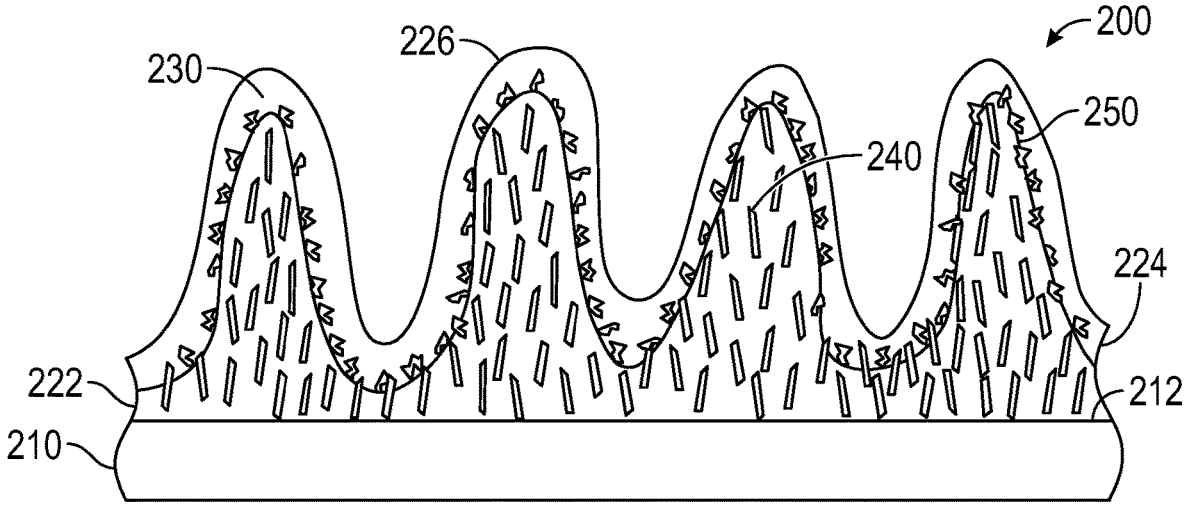
FIG. 2 is a schematic enlarged side view of exemplary coated abrasive article 200 according to the present disclosure.

Referring now to FIG. 2, coated abrasive article 200 comprises backing 210 having a major surface 212. Make layer 222 is disposed on major surface 212. Make layer 222 has an outer major surface 224 opposite backing 210. Outer major surface 224 comprises ridges 230. Make layer 222 comprises magnetizable particles 240. Ridges 230 are irregularly shaped and are oriented substantially parallel to one another. Abrasive particles 250 are secured to (e.g., partially embedded in) make layer proximate outer major surface 224. Optional size layer 226 is disposed over the outer major surface of the make layer and the abrasive particles.

In this embodiment, the abrasive particles can be non-magnetizable, for example, as described hereinabove or magnetizable. Examples of magnetizable abrasive grains include many synthetic diamonds, abrasive agglomerates containing magnetizable particles and abrasive particles, and otherwise non-magnetizable abrasive particles (grains) that have various magnetizable coatings thereon, for example, as described in U.S. Pat. Appl. Publ. Nos. 2019/0249052 A1 (Eckel et al.), 2019/0264081 A1 (Anderson et al.), 2019/0270183 A1 (Eckel et al.), 2019/0270922 A1 (Eckel et al.), 2019/0329380 A1 (Eckel et al.), 2019/0344403 A1 (Eckel et al.), and 2020/0071584 A1 (Anderson et al.).

Depending on the homogeneity of the magnetic field lines applied during manufacture, the ridges may have a slope relative to the major surface of the backing that varies by location. That is, while locally ridges are oriented with their longitudinal axis and, if applicable, tilt substantially parallel to adjacent ridges, at distances that are distant different orientations of the longitudinal axis and tilt may occur. Additionally, if magnetizable abrasive particles are present in the abrasive layer, they can be oriented relative to the backing by the influence of the magnetic field.

In cases of homogenous magnetic field, substantial uniformity of the ridges in the abrasive layer is typically observed, although this is not a requirement. In some embodiments, the ridges are tilted perpendicular to the major surface of the backing. In some embodiments, the ridges are tilted at an acute angle relative to the major surface of the backing. In yet other embodiments, the ridges are alternately gradually tilted at increasing and decreasing angles, according to a regular pattern, relative to the major surface of the backing. This can be achieved by changing the orientation and/or modulation of the magnetic field during manufacture.

An abrasive article according to the present disclosure can be made, for example, by the sequential steps of:

providing a curable binder precursor layer on the backing, wherein the curable binder precursor layer has an outer major surface opposite the backing, wherein the curable binder precursor layer comprises magnetizable particles and non-magnetizable abrasive particles dispersed in a curable binder precursor;

forming ridges on the outer major surface of the curable binder precursor layer by modulation of at least one magnetic field relative to the backing; and at least partially curing the curable binder precursor thereby providing an at least partially cured layer.

Curable binder precursors (e.g., slurry layer precursor, make layer precursor, and/or size layer precursor) may be coated by any method, including, for example, those known in the art. Examples include roll coating, slot coating, curtain coating, brush coating, knife coating, bar coating, spray coating, and gravure coating.

In general, applied magnetic fields used in practice of the present disclosure have a field strength in the region of the magnetizable particles being affected (e.g., attracted and/or oriented) of at least about 10 gauss (1 mT), preferably at least about 100 gauss (10 mT), and more preferably at least about 1000 gauss (0.1 T), although this is not a requirement. Modulation of the magnetic field may be accomplished for example using one or more rotating permanent magnets (e.g., rare earth magnets) and/or by electronic modulation of an array of electromagnetic elements, or by electromagnets disposed above and below the coated backing web.

Figure 3:
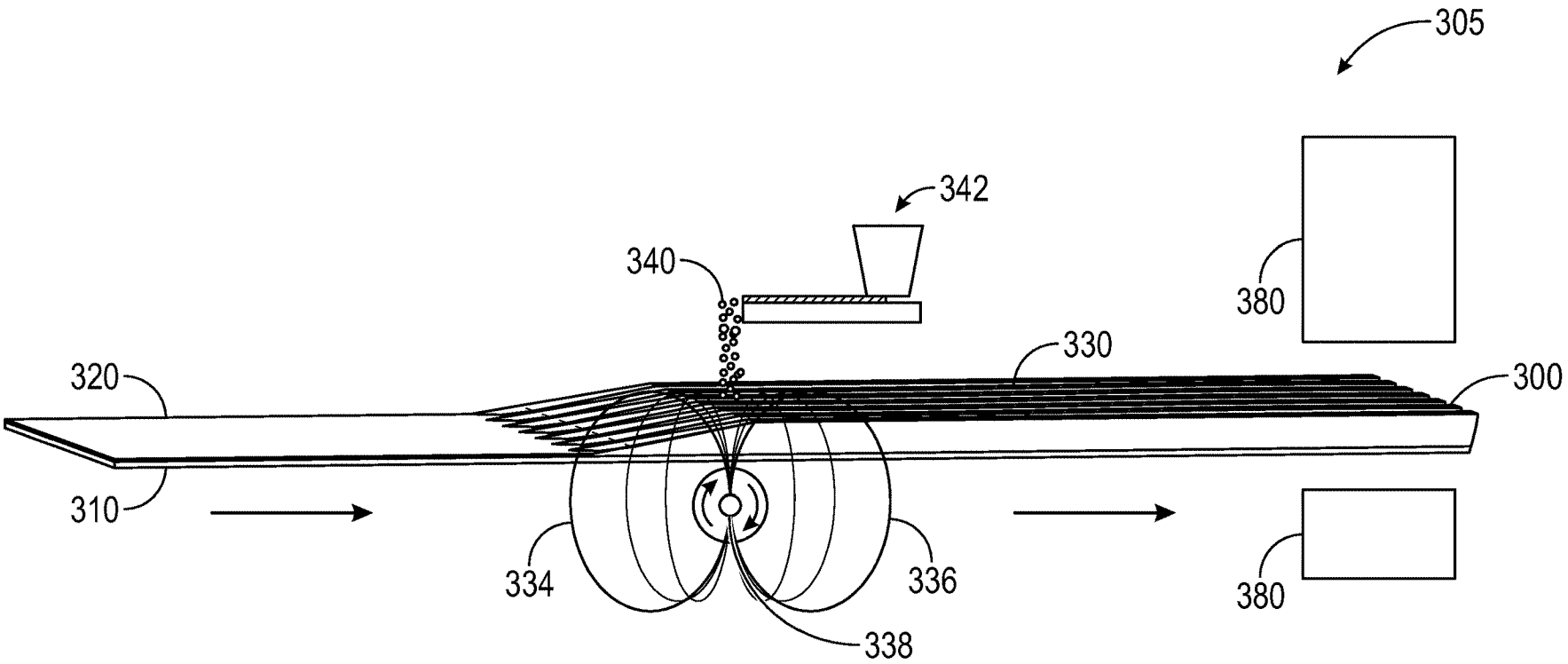
FIG. 3 is a schematic process 305 for making a coated abrasive article 300 according to the present disclosure.
Figure 3A:
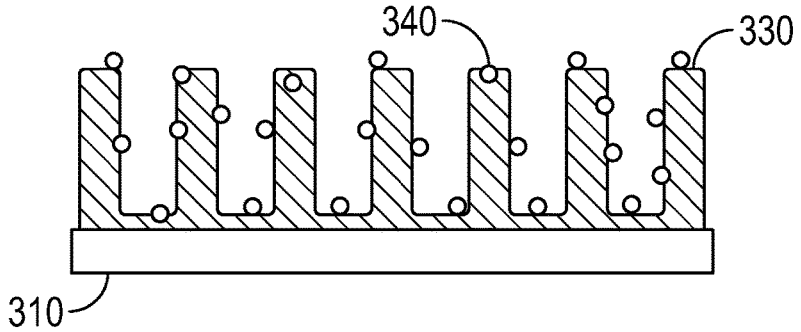
FIG. 3A is a schematic end view of a coated abrasive article 300 prepared according to process 305.

Referring now to FIGS. 3 and 3A, in an exemplary process 305 for making a coated abrasive article 300 according to the present disclosure, curable binder precursor layer 320, containing magnetizable particles dispersed in a curable binder precursor, (both not shown) is disposed on backing 310 and travels until it encounters the applied magnetic field 336 provided by a rotating magnet 334 having a rotational axis 338 that is substantially parallel to the crossweb direction of at least a portion of the backing 310 within the applied magnetic field 336. In steady state operation, as the coated backing (web) travels from upstream to downstream along the web path, the magnetizable particles in the curable binder precursor layer 320 are influenced by the applied magnetic field and form ridges 330 in the curable binder precursor layer. While the ridges 330 are still being influenced by magnetic field 336, abrasive particles 340 are deposited onto the surface of the ridges in order to substantially retain their shape before being cured by oven 380. At this point, the curable binder precursor can be sufficiently cured by oven 380 to retain the ridges once outside the strongest region of the applied magnetic field, and abrasive particles 340 are deposited from dispenser 342 onto on the layer of curable binder precursor before the ridges are sufficiently cured to retain their shape outside region 335.

In another embodiment, a coated abrasive article according to the present disclosure can be made by providing a curable binder precursor layer on a major surface of a backing. The curable binder precursor layer (e.g., a make layer precursor) has an outer major surface opposite the backing. The curable binder precursor layer comprises magnetizable particles dispersed in a curable binder precursor. Next, ridges are formed on the outer major surface of the curable binder precursor layer by modulation of at least one magnetic field relative to the backing; for example as discussed above. While still at most partially cured, abrasive particles are deposited to the outer major surface of the binder precursor layer. After deposition of the abrasive particles (e.g., by electrostatic deposition or drop coating) the at least partially curable binder precursor is at least partially cured, for example, by exposure to heat and/or actinic radiation to provide an at least partially cured layer. Optionally, but typically, a curable size layer precursor is then disposed over the at least partially cured layer; and at least partially cured to provide a coated abrasive article. Optionally, a supersize layer may be disposed on at least a portion of the size layer.

Further details regarding coated abrasive articles and methods of their manufacture can be found, for example, in U.S. Pat. No. 4,734,104 (Broberg); U.S. Pat. No. 4,737,163 (Larkey); U.S. Pat. No. 5,203,884 (Buchanan et al.); 5,152,917 (Pieper et al.); 5,378,251 (Culler et al.); 5,436,063 (Follett et al.); 5,496,386 (Broberg et al.); 5,609,706 (Benedict et al.); U.S. Pat. No. 5,520,711 (Helmin); U.S. Pat. No. 5,961,674 (Gagliardi et al.), and U.S. Pat. No. 5,975,988 (Christianson).

SELECT EMBODIMENTS OF THE DISCLOSURE

In a first embodiment, the present disclosure provides a coated abrasive article comprising a backing having a major surface with an abrasive layer disposed thereon, wherein the abrasive layer has an outer major surface comprising ridges separated by valleys, wherein the abrasive layer comprises magnetizable particles and abrasive particles dispersed in a binder, wherein the abrasive particles comprise at least one of rods, shaped platelets, or crushed abrasive particles conforming to an abrasives industry specified nominal grade, and wherein each one of the ridges is irregularly shaped and is oriented along at least a portion of its length substantially parallel to adjacent ridges.

In a second embodiment, the present disclosure provides a coated abrasive article according to the first embodiment, wherein the abrasive layer is discontinuous.

In a third embodiment, the present disclosure provides a coated abrasive article according to the first or second embodiment, wherein the ridges are perpendicular to the major surface of the backing.

In a fourth embodiment, the present disclosure provides a coated abrasive article according to any of the first to third embodiments, wherein the ridges are tilted at an acute angle relative to the major surface of the backing.

In a fifth embodiment, the present disclosure provides a coated abrasive article according to any of the first to third embodiments, wherein the ridges are alternately gradually tilted at increasing and decreasing angles, according to a regular pattern, relative to the major surface of the backing.

In a sixth embodiment, the present disclosure provides a coated abrasive article according to any of the first to fifth embodiments, wherein the backing is compressible and resilient.

In a seventh embodiment, the present disclosure provides a coated abrasive article comprising:

a backing having a major surface and having a make layer disposed thereon, wherein the make layer has an outer major surface opposite the backing, wherein the outer major surface comprises ridges and valleys, wherein the make layer comprises magnetizable particles, and wherein each one of the ridges is irregularly shaped and is oriented along at least a portion of its length substantially parallel to adjacent ridges; and abrasive particles secured to the make layer proximate the outer major surface of the make layer.

In an eighth embodiment, the present disclosure provides a coated abrasive article according to the seventh embodiment, wherein the abrasive particles comprise at least one of rods, shaped platelets, or crushed abrasive particles conforming to an abrasives industry specified nominal grade.

In a ninth embodiment, the present disclosure provides a coated abrasive article according to the seventh or eighth embodiment, further comprising a size layer disposed over at least a portion of the outer major surface of the make layer and the abrasive particles.

In a tenth embodiment, the present disclosure provides a coated abrasive article according to any of the seventh to ninth embodiments, wherein the make layer is discontinuous.

In an eleventh embodiment, the present disclosure provides a coated abrasive article according to any of the seventh to tenth embodiments, wherein the ridges are substantially perpendicular to the major surface of the backing.

In a twelfth embodiment, the present disclosure provides a coated abrasive article according to any of the seventh to eleventh embodiments, wherein the ridges are tilted at an acute angle relative to the major surface of the backing.

In a thirteenth embodiment, the present disclosure provides a coated abrasive article according to any of the seventh to twelfth embodiments, wherein the ridges are alternately gradually tilted at increasing and decreasing angles, according to a regular pattern, relative to the major surface of the backing.

In a fourteenth embodiment, the present disclosure provides a coated abrasive article according to any of the seventh to thirteenth embodiments, wherein the backing is compressible and resilient.

In a fifteenth embodiment, the present disclosure provides a method of making a coated abrasive article, the method comprising:

providing a curable binder precursor layer on a backing, wherein the curable binder precursor layer has an outer major surface opposite the backing, wherein the curable binder precursor layer comprises magnetizable particles and abrasive particles dispersed in a curable binder precursor, and wherein the abrasive particles comprise at least one of rods, shaped platelets, or crushed abrasive particles conforming to an abrasives industry specified nominal grade;

forming ridges on the outer major surface of the curable binder precursor layer by modulation of at least one magnetic field relative to the backing; and at least partially curing the curable binder precursor thereby providing an at least partially cured layer.

In a sixteenth embodiment, the present disclosure provides a method of making a coated abrasive article, the method comprising sequentially:

providing a curable binder precursor layer on a major surface of a backing, wherein the curable binder precursor layer has an outer major surface opposite the backing, wherein the curable binder precursor layer comprises magnetizable particles dispersed in a curable binder precursor;

forming ridges on the outer major surface of the curable binder precursor layer by modulation of at least one magnetic field relative to the backing;

adhering abrasive particles to the outer major surface of the curable binder precursor layer; and at least partially curing the curable binder precursor thereby providing an at least partially cured layer.

In a seventeenth embodiment, the present disclosure provides a method according to the sixteenth embodiment, further comprising:

disposing a curable size layer precursor over the at least partially cured layer; and at least partially curing the curable size layer precursor.

In an eighteenth embodiment, the present disclosure provides a method according to the sixteenth or seventeenth embodiment, wherein the abrasive particles comprise at least one of rods, shaped platelets, or crushed abrasive particles conforming to an abrasives industry specified nominal grade.

In a nineteenth embodiment, the present disclosure provides a method according to the fifteenth to eighteenth embodiments, wherein the abrasive particles are non-magnetizable.

In a twentieth embodiment, the present disclosure provides a method according to the fifteenth to nineteenth embodiments, wherein at least some of the abrasive particles are magnetizable.

In a twenty-first embodiment, the present disclosure provides a method of making a coated abrasive article, the method comprising sequentially:

providing a curable binder precursor layer on a first major surface of a backing, wherein the curable binder precursor layer has an outer major surface opposite the backing, wherein the curable binder precursor layer comprises magnetizable particles dispersed in a curable binder precursor;

adhering abrasive particles to the outer major surface of the curable binder precursor layer;

forming ridges on the outer major surface of the curable binder precursor layer by modulation of at least one magnetic field relative to the backing; and at least partially curing the curable binder precursor thereby providing an at least partially cured layer.

In a twenty-second embodiment, the present disclosure provides a method according to the twenty-first embodiment, further comprising:

disposing a curable size layer precursor over the at least partially cured layer; and at least partially curing the curable size layer precursor.

In a twenty-third embodiment, the present disclosure provides a method according to the twenty-first or twenty-second embodiment, wherein the abrasive particles are non-magnetizable.

In a twenty-fourth embodiment, the present disclosure provides a method according to any of the twenty-first to twenty-third embodiments, wherein the abrasive particles comprise at least one of rods, shaped platelets, or crushed abrasive particles conforming to an abrasives industry specified nominal grade.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Abbreviations for materials and reagents used in the Examples are reported in TABLE 1, below

TABLE 1

| | |
|---|---|
| PF1 | Phenol-formaldehyde resin having a phenol to formaldehyde molar ratio of 1.5-2.1, and catalyzed with 2.5 percent by weight potassium hydroxide |
| FLK1 | Stainless Steel Flake Fine Leafing Grade supplied by Novamet Corp., Lebanon, Tennessee |
| MAKE1 | Make coat resin prepared by combining 1000 grams (g) of PF1 and 1000 g of FLK1 in a plastic container and stirred with an air powered rotary mixer until evenly distributed. |
| BACK1 | Polyester backing, according to the description disclosed in Example 12 in U.S. Pat. No. 6,843,815 (Thurber et al.). Material was converted to a width of 4 inches (10.2 cm) |
| MIN1 | ANSI grade P100 Silicon Carbide abrasive mineral, obtained from Washington Mills Electro Minerals Corporation, Niagara Falls, New York. |
| MAG1 | An N52 Neodymium magnet assembly made up of three 2-inch (5.1-cm)diameter by 2-inch (5.1 cm) long magnets to create a cylinder with a total length of 6 inches (15.2 cm) and a diameter of 2 inches (5.1 cm). Magnets supplied by KJ magnetics part number RY04Y0DIA diametrically magnetized. |
| SIZE1 | A size resin composed of 42.10% GP 8339 PF resin, 22.13% Wollastocoat M400, 22.13% Cryolite, 1.55% Iron Oxide, 12.09% Water |

Example 1

BACK1 was threaded through a notch bar coater. MAKE1 was poured into the notch bar coater and set at a coating height of 0.030 inch (0.76 mm). BACK1 was passed through the notch bar coater and moved downweb at a rate of 10 feet per minute (3.0 m/min). Resin-coated BACK1 was passed over the top of MAG1 with a gap maintained of 0.25 inch (6.4 mm). MAG1 was rotated at 2000 revolutions per minute (RPM) about its axis using a direct current (DC) electric motor with a 0.25 inch (6.4 mm) diameter shaft mounted through the center of MAG1. MAG1 was mounted on its side with its axis underneath and cross-web to BACK1. The apparatus configuration generally corresponded to that shown in FIG. 3.

Upon passing over MAG1, MAKE1 formed into periodic structures on the surface of BACK1 with significantly taller height than the initial coating thickness.

MIN1 was drop coated onto the top of the periodic structures at an approximate weight of 170 grains per 4-inch (10.2-cm) by 6-inch area (15.2 cm) while still in the presence of the magnetic field. As the resultant material continued downweb and exited the strength of the magnetic field, the periodic structures maintained the majority of their shape.

Four-foot (1.2-m) long sections of the resulting construction were cut out and placed into an oven. Oven was heated at 65.6° C. for 15 minutes followed by 90 minutes at 98.9° C.

These sections were size coated with SIZE1 using a lofty paint roller. The minimum coat weight was applied that provided full coverage of the surface. The sections were returned to the oven at 65.6° C. for 60 minutes and 98.9° C. for 8 hours.

Abrasive discs (2-inch (5.1-cm) diameter) were converted out of the cured sections. A mechanical fastener button (3M Roloc) was thermally secured onto the back side of the backing for mounting to a servo motor shaft for performance testing. Performance testing of a representative disc was conducted at 7500 RPM, a downward force of 5 pounds (2.3 kg), and an angle of 5 degrees. They were mounted on a 2-inch (5.1-cm) diameter backup pad and tested on 1018 steel with a wet process. Water was dispensed onto the abrading surface during testing.

Comparative Example A

A 3M 461F P100 grit cloth abrasive belt (3M Company) was converted to 2-inch (5.1-cm) diameter abrasive discs and a mechanical fastener button (3M Roloc) was attached as in Example 1. A representative coated abrasive disc was tested with an identical process to that in Example 1.

Figure 4:
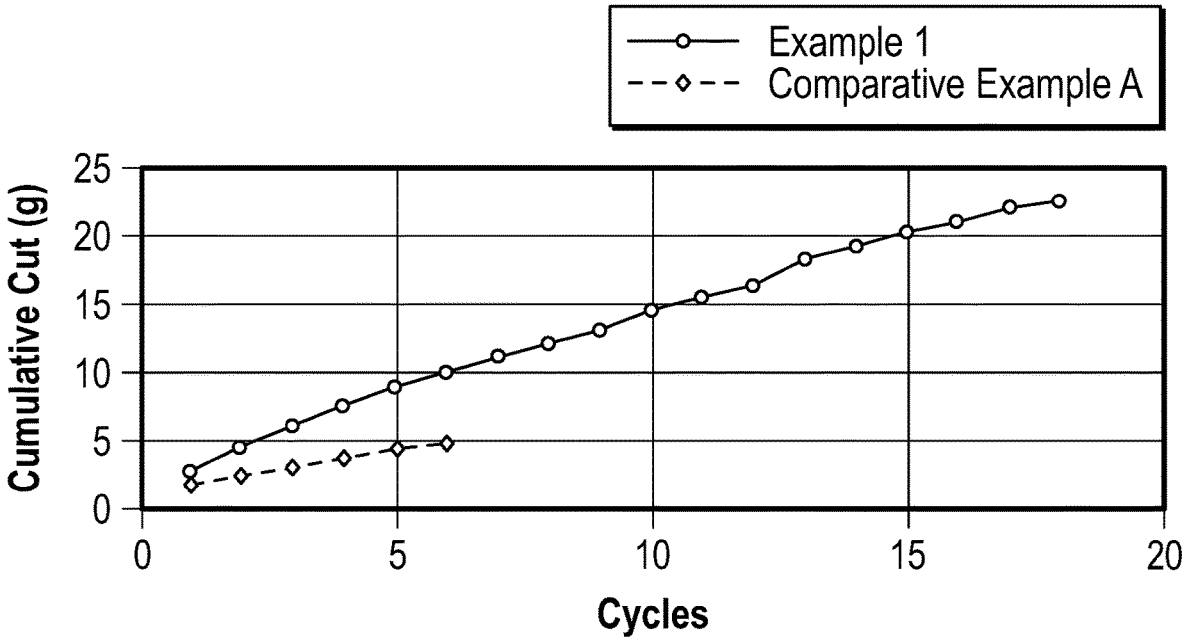
FIG. 4 is a plot of total cut versus number of cycles for Example 1 and Comparative Example A.

Results are reported in Table 2, below and in FIG. 4.

TABLE 2

| | TOTAL CUT, grams | TOTAL ABRADING CYCLES, 1 MINUTE EACH |
|---|---|---|
| EXAMPLE 1 | 22.75 | 18 |
| COMPARATIVE EXAMPLE A | 4.82 | 6 |

All cited references, patents, and patent applications in this application are incorporated by reference in a consistent manner. In the event of inconsistencies or contradictions between portions of the incorporated references and this application, the information in this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. A coated abrasive article comprising a backing having a major surface with an abrasive layer disposed thereon, wherein the abrasive layer has an outer major surface comprising ridges separated by valleys, wherein the abrasive layer comprises magnetizable particles and abrasive particles dispersed in a binder, wherein the abrasive particles comprise at least one of rods, shaped platelets, or crushed abrasive particles conforming to an abrasives industry specified nominal grade, and wherein each one of the ridges is irregularly shaped, has a length, and is oriented along at least a portion of its said length substantially parallel to adjacent ridges.

2. The coated abrasive article of claim 1, wherein the ridges are perpendicular to the major surface of the backing.

3. The coated abrasive article of claim 1, wherein the backing is compressible and resilient.

4. The coated abrasive article of claim 1, wherein the abrasive layer is discontinuous.

5. The coated abrasive article of claim 1, wherein the ridges are tilted at an acute angle relative to the major surface of the backing.

6. The coated abrasive article of claim 1, wherein the ridges are alternately gradually tilted at increasing and decreasing angles, according to a regular pattern, relative to the major surface of the backing.

7. The coated abrasive article of claim 1, wherein the abrasive particles are non-magnetizable.

8. A coated abrasive article comprising:

a backing having a major surface and having a make layer disposed thereon, wherein the make layer has an outer major surface opposite the backing, wherein the outer major surface comprises ridges and valleys, wherein the make layer comprises magnetizable particles, and wherein each one of the ridges is irregularly shaped, has a length, and is oriented along at least a portion of its said length substantially parallel to adjacent ridges; and abrasive particles secured to the make layer proximate the outer major surface of the make layer.

9. The coated abrasive article of claim 8, wherein the abrasive particles comprise at least one of rods, shaped platelets, or crushed abrasive particles conforming to an abrasives industry specified nominal grade.

10. The coated abrasive article of claim 8, further comprising a size layer disposed over the outer major surface of the make layer and the abrasive particles.

11. The coated abrasive article of claim 8, wherein the ridges are perpendicular to the major surface of the backing.

12. The coated abrasive article of claim 8, wherein the backing is compressible and resilient.

13. The coated abrasive article of claim 8, wherein the make layer is discontinuous.

14. The coated abrasive article of claim 8, wherein the ridges are tilted at an acute angle relative to the major surface of the backing.

15. The coated abrasive article of claim 8, wherein the ridges are alternately gradually tilted at increasing and decreasing angles, according to a regular pattern, relative to the major surface of the backing.

16. The coated abrasive article of claim 8, wherein the abrasive particles are non-magnetizable.

17. The coated abrasive article of claim 8, wherein the abrasive particles are magnetizable.

18. A method of making a coated abrasive article, the method comprising:

providing a curable binder precursor layer on a backing, wherein the curable binder precursor layer has an outer major surface opposite the backing, and wherein the curable binder precursor layer comprises magnetizable particles dispersed in a curable binder precursor;

forming ridges on the outer major surface of the curable binder precursor layer by modulation of at least one magnetic field relative to the backing; and at least partially curing the curable binder precursor thereby providing an at least partially cured layer, wherein the curable binder precursor further comprises abrasive particles dispersed therein; or the method further comprises adhering abrasive particles to the outer major surface of the curable binder precursor layer before or after forming ridges on the outer major surface of the curable binder precursor layer; and wherein the abrasive particles comprise at least one of rods, shaped platelets, or crushed abrasive particles conforming to an abrasives industry specified nominal grade.

19. The method of claim 18, further comprising adhering abrasive particles to the outer major surface of the curable binder precursor layer before or after forming ridges on the outer major surface of the curable binder precursor layer.

20. The method of claim 19, further comprising:

disposing a curable size layer precursor over the at least partially cured layer; and at least partially curing the curable size layer precursor.

* * * * *